US008033657B2

(12) United States Patent
Sasaki

(10) Patent No.: US 8,033,657 B2
(45) Date of Patent: Oct. 11, 2011

(54) IMAGE FORMING APPARATUS INCLUDING LIQUID DISCHARGE HEAD UNIT

(75) Inventor: Takafumi Sasaki, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 423 days.

(21) Appl. No.: 12/164,383

(22) Filed: Jun. 30, 2008

(65) Prior Publication Data

US 2009/0009569 A1 Jan. 8, 2009

(30) Foreign Application Priority Data

Jul. 3, 2007 (JP) ..... 2007-174936

(51) Int. Cl.
*B41J 2/18* (2006.01)
*B41J 2/175* (2006.01)

(52) U.S. Cl. ..... 347/89; 347/85

(58) Field of Classification Search ..... 347/7, 85, 347/89, 92, 93
See application file for complete search history.

(56) References Cited

U.S. PATENT DOCUMENTS

| | | | | |
|---|---|---|---|---|
| 4,568,953 | A * | 2/1986 | Aoki et al. | 347/65 |
| 5,561,448 | A * | 10/1996 | Kaneko et al. | 347/29 |
| 2005/0082628 | A1 | 4/2005 | Kawasaki et al. | |

FOREIGN PATENT DOCUMENTS

| | | |
|---|---|---|
| JP | 2-179757 | 7/1990 |
| JP | 3-213350 | 9/1991 |
| JP | 5-8400 | 1/1993 |
| JP | 3090698 | 7/2000 |
| JP | 2006-68904 | 3/2006 |
| JP | 2006-88493 | 4/2006 |
| JP | 3885226 | 12/2006 |

OTHER PUBLICATIONS

U.S. Appl. No. 11/786,725, filed Apr. 11, 2007.

* cited by examiner

*Primary Examiner* — Geoffrey Mruk
(74) *Attorney, Agent, or Firm* — Cooper & Dunham LLP

(57) ABSTRACT

An image forming apparatus including a liquid discharge head unit which in turn includes (a) a liquid discharge head including multiple liquid chambers connected to multiple nozzles for discharging liquid droplets, and a common liquid chamber including a liquid supply opening and a liquid discharge opening, to supply a liquid to the multiple liquid chambers, (b) a sub tank including a liquid container, connected to the liquid supply opening to store the liquid to be supplied to the liquid discharge head, (c) a tank connected to the liquid discharge opening to store the liquid used for filling the liquid discharge head, and (d) a mechanism to return the liquid in the tank to the sub tank.

14 Claims, 9 Drawing Sheets

IMAGE FORMING APPARATUS INCLUDING LIQUID DISCHARGE HEAD UNIT

BACKGROUND

1. Technical Field

This disclosure relates to an image forming apparatus including a liquid discharge head unit.

2. Description of the Background

One example of related-art image forming apparatuses having two or more of printing, copying, plotting, and facsimile functions includes a liquid discharge device including a recording head. The recording head includes a liquid discharge head configured to discharge droplets of a recording liquid such as ink. The ink discharged from the recording head adheres to a recording medium, such as a sheet, while the sheet is conveyed so that an image is formed on the sheet.

An image forming apparatus hereinafter described forms an image on a recording medium, such as paper, string, fiber, cloth, lather, metal, plastics, glass, wood, and ceramics by discharging a liquid onto the recording medium. An image hereinafter described refers to a significant image such as characters and figures, as well as a non-significant image such as patterns. A liquid hereinafter described is not limited to a recording liquid and ink, but also includes a material which is a liquid when discharged from a recording head, such as a DNA sample, a resist material, and a pattern material. A liquid discharge device hereinafter described is a device configured to discharge the liquid from a liquid discharge head, as well as a device configured to form the image.

During, before, and after discharging the liquid (hereinafter referred to as ink), liquid chambers and a common liquid chamber of the liquid discharge head are required to be filled with the ink without bubbles to reliably discharge the liquid.

However, because the liquid discharge head is filled with air before being initially filled with the ink, bubbles are easily included in the ink during the initial filling operations. Moreover, a larger amount of air enters the liquid chambers and the common liquid chamber from a nozzle due to application of a large amount of negative pressure and other factors, causing bubbles in the ink.

It is required to surely remove the air in the liquid chambers and the common liquid chamber and the bubbles in the ink in order to reliably discharge the ink from the liquid discharge head. Particularly, in a case in which a long liquid discharge head such as a line-type liquid discharge head is used to increase a printing speed, a longer common liquid chamber is required so that pressure loss of the ink in the common liquid chamber increases. Consequently, a speed of flow of the ink decreases severely at a portion farthest from an ink supply opening of the common liquid chamber, and bubbles and other foreign materials tend to remain at that portion, possibly causing improper discharge of the ink.

To solve the above-described problems, a liquid discharge head including a circulation supply system in which a common liquid chamber does not have components to block a flow of ink has been proposed. For example, Japanese Patent No. (hereinafter referred to as JP) 3090698 discloses an inkjet recording device including a first flow path configured to connect a recording head and an ink tank, in which an ink supply unit for supplying ink from the ink tank to the recording head is provided, a second flow path configured to connect the recording head and the ink tank, in which a first backflow prevention unit for preventing the ink from flowing to the recording head from the ink tank is provided, and a third flow path configured to connect the ink tank and a portion between the ink supply unit and the recording head, in which a second backflow prevention unit for preventing the ink from flowing to the ink tank from the recording head is provided.

The above-described inkjet recording device is described in detail below with reference to FIG. 1. First, a pump 503 is normally rotated while a check valve 501 is opened and a check valve 502 is closed so that ink is supplied to a recording tank 504 from a main tank. Subsequently, the pump 503 is reversely rotated while the check valves 501 and 505 are closed and the check valve 502 is opened so that the ink flows to the check valve 502, a flow path 506, a filter 507, a common liquid chamber 508, a flow path 509, an electromagnetic valve 510, and the recording tank 504 in this order, as indicated by a dashed arrow in FIG. 1. Meanwhile, during image formation, the electromagnetic valve 510 is closed and the ink is supplied to a liquid path 512 from the recording tank 504 through a liquid path 511, the liquid path 506, the filter 507, and the common liquid chamber 508 in this order, as indicated by a virtual arrow in FIG. 1 so that ink droplets are discharged from a nozzle 513. The recording tank 504 includes a release valve 515.

Other examples of inkjet recording devices and image recorders are also disclosed in JP 3885226 and published unexamined Japanese Patent application Nos. (hereinafter referred to as JP-As) 2006-068904, 2006-088493, 03-213350, 02-179757, and 05-008400.

However, the above-described examples do not fully solve the problems. For example, in the inkjet recording device disclosed in JP 3090698, the flow path used for filling the recording head with the ink is separately provided from the flow path used for recording. Consequently, the inkjet recording device needs a more complicated configuration. Moreover, a large number of check valves and electromagnetic valves is needed, causing cost increase and requiring more complicated control operations.

SUMMARY

In an aspect of this disclosure, an image forming apparatus is provided which includes a liquid discharge head unit having a simple configuration, in which a liquid used for initial filling operations is collected for reuse.

In an exemplary embodiment, an image forming apparatus includes a liquid discharge head unit which in turn includes (a) a liquid discharge head including multiple liquid chambers connected to multiple nozzles for discharging liquid droplets, and a common liquid chamber including a liquid supply opening and a liquid discharge opening, to supply a liquid to the multiple liquid chambers, (b) a sub tank including a liquid container, connected to the liquid supply opening to store the liquid to be supplied to the liquid discharge head, (c) a tank connected to the liquid discharge opening to store the liquid used for filling the liquid discharge head and (d) a mechanism to return the liquid in the tank to the sub tank.

In another exemplary embodiment, the liquid discharge head unit comprises (i) a liquid discharge head including multiple liquid chambers connected to multiple nozzles for discharging liquid droplets, and a common liquid chamber to supply a liquid to the multiple liquid chambers, (ii) a sub tank including a liquid container, to store the liquid to be supplied to the liquid discharge head, (iii) a filter provided between the common liquid chamber and the liquid container of the sub tank, (iv) a tank connected to the common liquid chamber to store the liquid used for filling the liquid discharge head, and (v) a mechanism to return the liquid in the tank to the sub tank.

In yet another exemplary embodiment, the liquid discharge head unit includes (A) a liquid discharge head including multiple liquid chambers connected to multiple nozzles for discharging liquid droplets, and a common liquid chamber including a liquid supply opening and a liquid discharge opening, to supply a liquid to the multiple liquid chambers, (B) a connection path to connect the liquid supply opening and the liquid discharge opening, (C) an open/close valve to open and close the connection path, (D) a tank provided between the liquid discharge opening and the open/close valve, (E) a valve to release pressure in the tank, and (F) a pump capable of normally and reversely rotating, connected to the liquid supply opening to convey the liquid to the liquid discharge head by pressure.

Additional aspects, features and advantages will be more fully apparent from the following detailed description of exemplary embodiments, the accompanying drawings, and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein like reference numerals designate identical or corresponding parts throughout the several views and wherein.

DETAILED DESCRIPTION OF THE EXEMPLARY EMBODIMENTS

Figure 1:
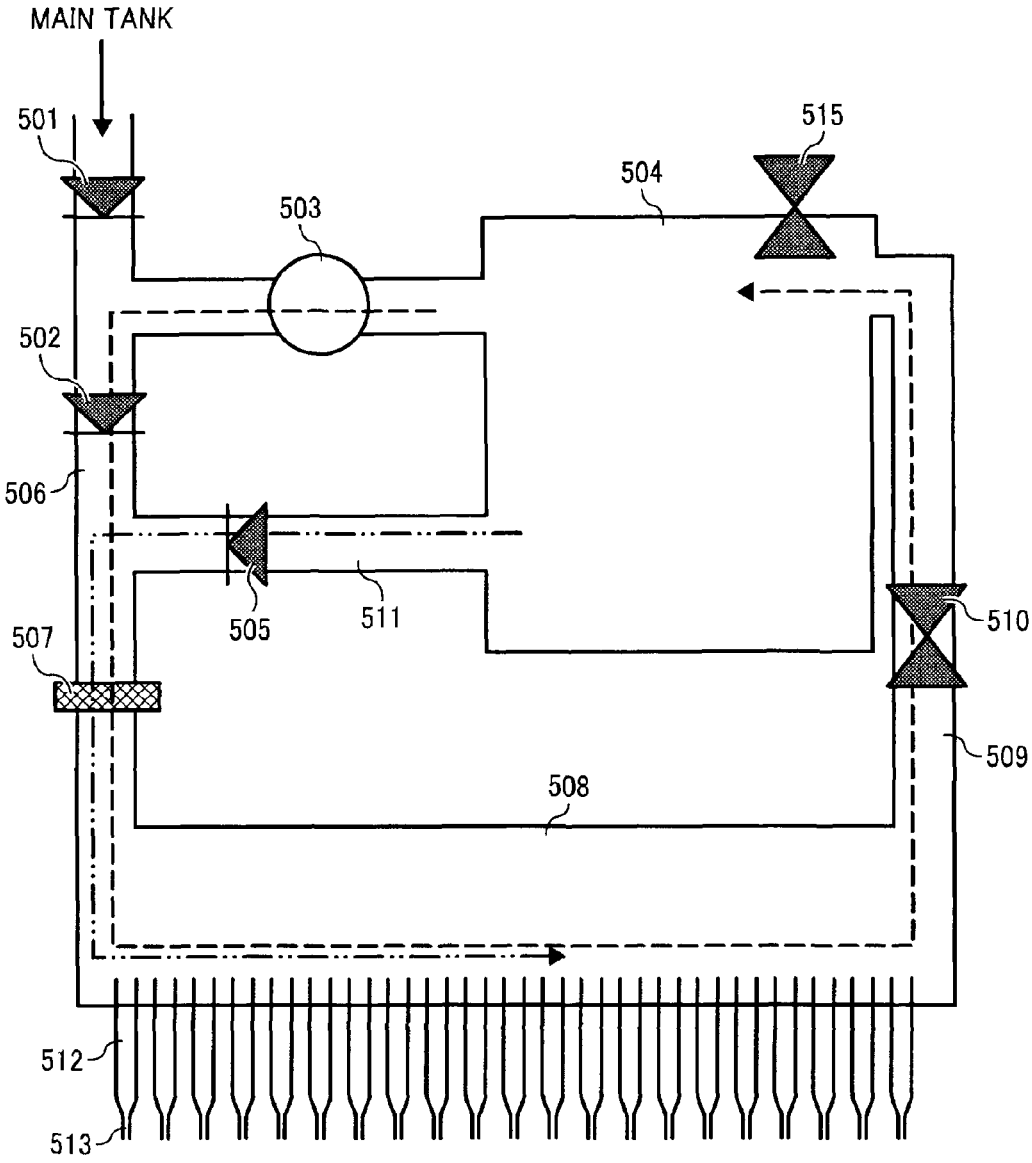
FIG. 1 RELATED ART
FIG. 1 is a schematic view illustrating an inkjet recording device in the related art.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Figure 2:
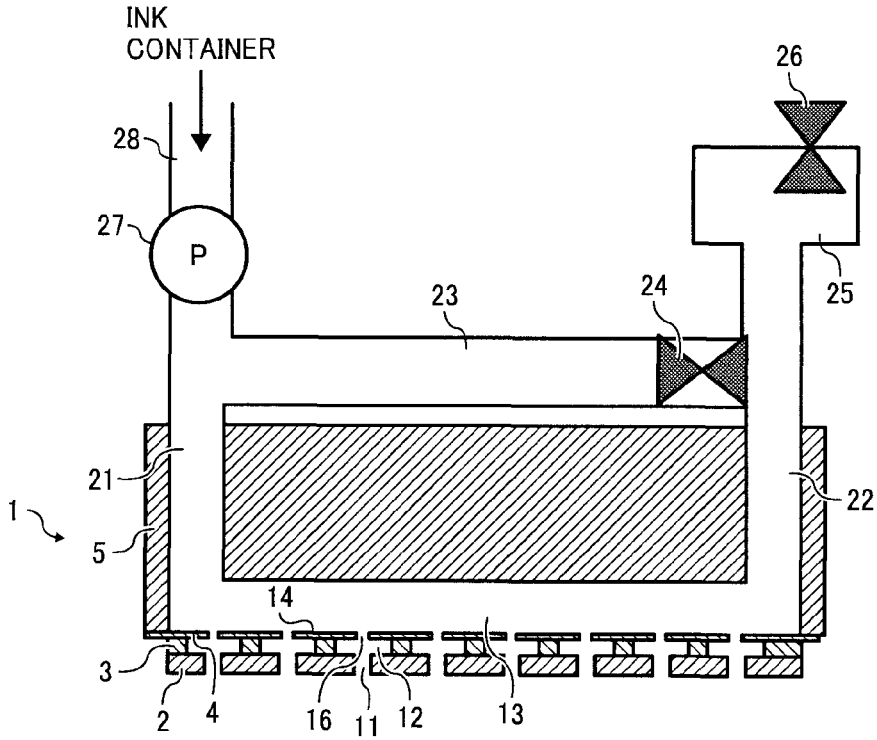
FIG. 2 is a vertical cross-sectional view illustrating a liquid discharge head unit according to a first exemplary embodiment of this disclosure, along a line A-A in FIG. 3.
Figure 3:
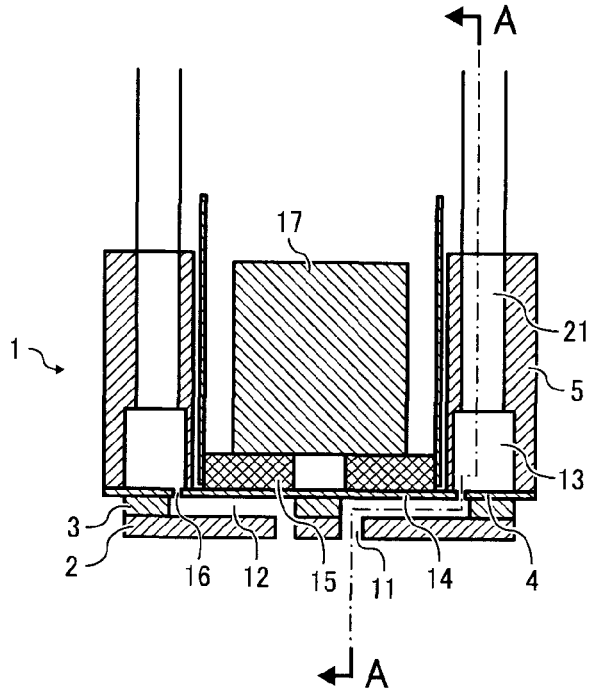
FIG. 3 is a vertical cross-sectional view illustrating the liquid discharge head unit illustrated in FIG. 2.

A liquid discharge head unit according to a first exemplary embodiment is described in detail below with reference to FIGS. 2 and 3. FIG. 2 is a vertical cross-sectional view illustrating the liquid discharge head unit according to the first exemplary embodiment along a line A-A in FIG. 3. FIG. 3 is a vertical cross-sectional view illustrating the liquid discharge head unit according to the first exemplary embodiment.

The liquid discharge head unit according to the first exemplary embodiment includes a liquid discharge head 1 configured to discharge liquid droplets. In the liquid discharge head 1, a nozzle plate 2, a flow path member 3, a vibration plate member 4, and a frame member 5 are laminated and bonded together. The liquid discharge head 1 is a piezoelectric head including multiple liquid chambers 12 to which multiple nozzles 11 for discharging the liquid droplets are connected, a common liquid chamber 13 configured to supply ink to the multiple liquid chambers 12 through multiple connection holes 16 provided on the vibration plate member 4, a vibration plate 14 forming a top surface of each of the multiple liquid chambers 12, and a piezoelectric actuator 15 fixed to a base member 17 and configured to apply pressure to the ink in the multiple liquid chambers 12 through the vibration plate 14. In place of the piezoelectric head, the liquid discharge head 1 may be a thermal head or an electrostatic head.

The liquid discharge head 1 further includes a supply opening 21 for supplying the ink to the common liquid chamber 13, and a discharge opening 22 for discharging the ink from the common liquid chamber 13, on the frame member 5 which forms the common liquid chamber 13.

The liquid discharge head 1 further includes a connection flow path 23 for connecting the supply opening 21 and the discharge opening 22, an open/close valve 24 for opening and closing the connection flow path 23, a liquid container 25 provided between the discharge opening 22 and the open/close valve 24, a release valve 26 for releasing pressure in the liquid container 25, and a pump 27 capable of normally and reversely rotating to convey the ink by pressure, provided between the supply opening 21 and an ink supply path 28 connected to the supply opening 21 and the connection flow path 23.

It should be noted that fluid resistance in the common liquid chamber 13 is set greater than that in the connection flow path 23.

A description is now given of initial filling operations performed in the liquid discharge head unit with the above-described configuration.

First, the pump 27 is normally rotated when the open/close valve 24 is closed and the release valve 26 is opened so as to supply ink from an ink container such as an ink cartridge and an ink tank, not shown, through the ink supply path 28. Accordingly, the ink is supplied to the common liquid chamber 13 through the supply opening 21, and further supplied to the liquid container 25 from the common liquid chamber 13 through the discharge opening 22. Because the release valve 26 is opened, the ink rarely flows in the multiple liquid chambers 12, and air in the liquid discharge head 1 and the liquid container 25 is discharged from the release valve 26.

The release valve 26 is closed before the ink comes out of the release valve 26. As a result, the ink is supplied to the multiple liquid chambers 12 by normally rotating the pump 27 continuously. Although the ink is discharged from the multiple nozzles 11, such ink is either collected or discarded by a cap member of a maintenance and recovery mechanism, not shown.

Next, the open/close valve 24 is opened, and the pump 27 is reversely rotated. As a result, the ink remaining in the liquid container 25 and the discharge opening 22 is channeled to the ink container through the connection flow path 23. The ink in the common liquid chamber 13 is prevented from being channeled to the ink container through the supply opening 21 by setting the fluid resistance in the connection flow path 23 smaller than that in the supply opening 21 and the common liquid chamber 13.

The reverse rotation of the pump 27 is stopped when a predetermined or desired amount of the ink is channeled to the ink container. The pump 27 is configured to function as a pipe line when the rotation thereof is stopped.

The ink container is provided vertically below the nozzle plate 2 on which the multiple nozzles 11 are formed such that negative pressure required for reliably discharging the ink from the multiple nozzles 11 is obtained by a head difference between the ink container and the nozzle plate 2.

Thus, as described above, the liquid discharge head 1 according to the first exemplary embodiment includes the multiple liquid chambers 12 connected to the multiple nozzles 11 for discharging the ink droplets, and the common liquid chamber 13 for supplying the ink to each of the multiple liquid chambers 12. The liquid discharge head 1 further includes the supply opening 21 and the discharge opening 22 provided in the common liquid chamber 13, the connection flow path 23 for connecting the supply opening 21 and the discharge opening 22, the open/close valve 24 for opening and closing the connection flow path 23, the liquid container 25 provided between the discharge opening 22 and the open/close valve 24, the release valve 26 for releasing pressure in the liquid container 25, and the pump 27 capable of normally and reversely rotating to convey the ink by pressure. Because the common liquid chamber 13 does not include components which block a flow of the ink, the common liquid chamber 13 is filled with the ink during the initial filling operations. Thereafter, the ink is supplied to each of the multiple liquid chambers 12 from the common liquid chamber 13, thereby more reliably filling the multiple liquid chambers 12 with the ink. Further, the ink remaining in the liquid container 25 and the discharge opening 22 is channeled to the ink container after the initial filling operations, thereby preventing waste of ink. Therefore, according to the first exemplary embodiment, the ink used for the initial filling operations can be collected for reuse with a simple configuration as described above.

Although the pump 27 is used for supplying and collecting the ink in the first exemplary embodiment, the ink may be supplied and collected by a head difference between the ink container and the liquid discharged head 1.

Figure 4:
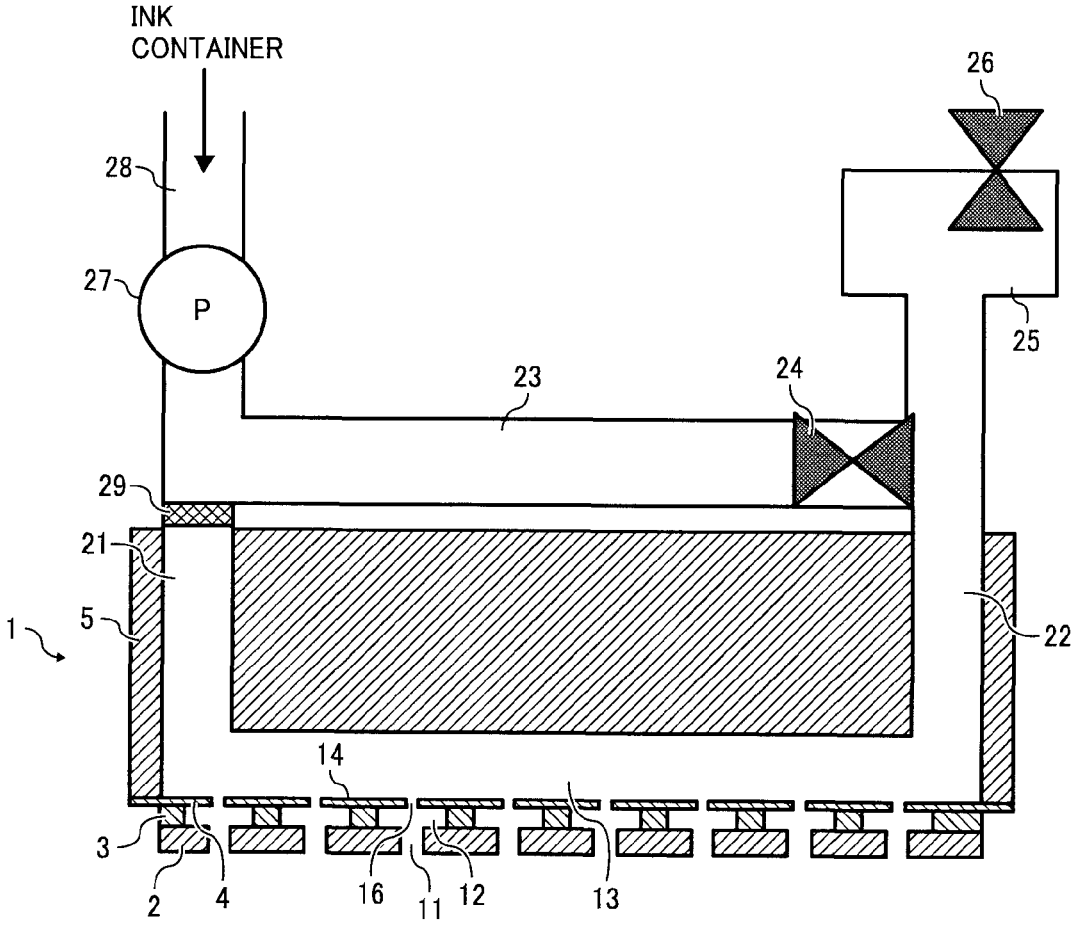
FIG. 4 is a vertical cross-sectional view illustrating a liquid discharge head unit according to a second exemplary embodiment viewed from a front side.

A description is now given of a liquid discharge head unit according to a second exemplary embodiment with reference to FIG. 4. FIG. 4 is a vertical cross-sectional view illustrating the liquid discharge head unit according to the second exemplary embodiment viewed from a front side.

The liquid discharge head 1 illustrated in FIG. 4 has the same configuration as that of the liquid discharge head unit 1 according to the first exemplary embodiment, except that a filter 29 for filtrating the ink is provided at an entry of the supply opening 21.

The filter 29 prevents foreign substances and bubbles from entering the common liquid chamber 13 and the multiple liquid chambers 12. Moreover, when the pump 27 is reversely rotated to return the excessive amount of the ink to the ink container, fluid resistance of a flow of the ink from the connection flow path 23 to the supply opening 21 is increased by the filter 29, thereby preventing the ink in the common liquid chamber 13 from being channeled from the supply opening 21 to the ink container.

Figure 5:
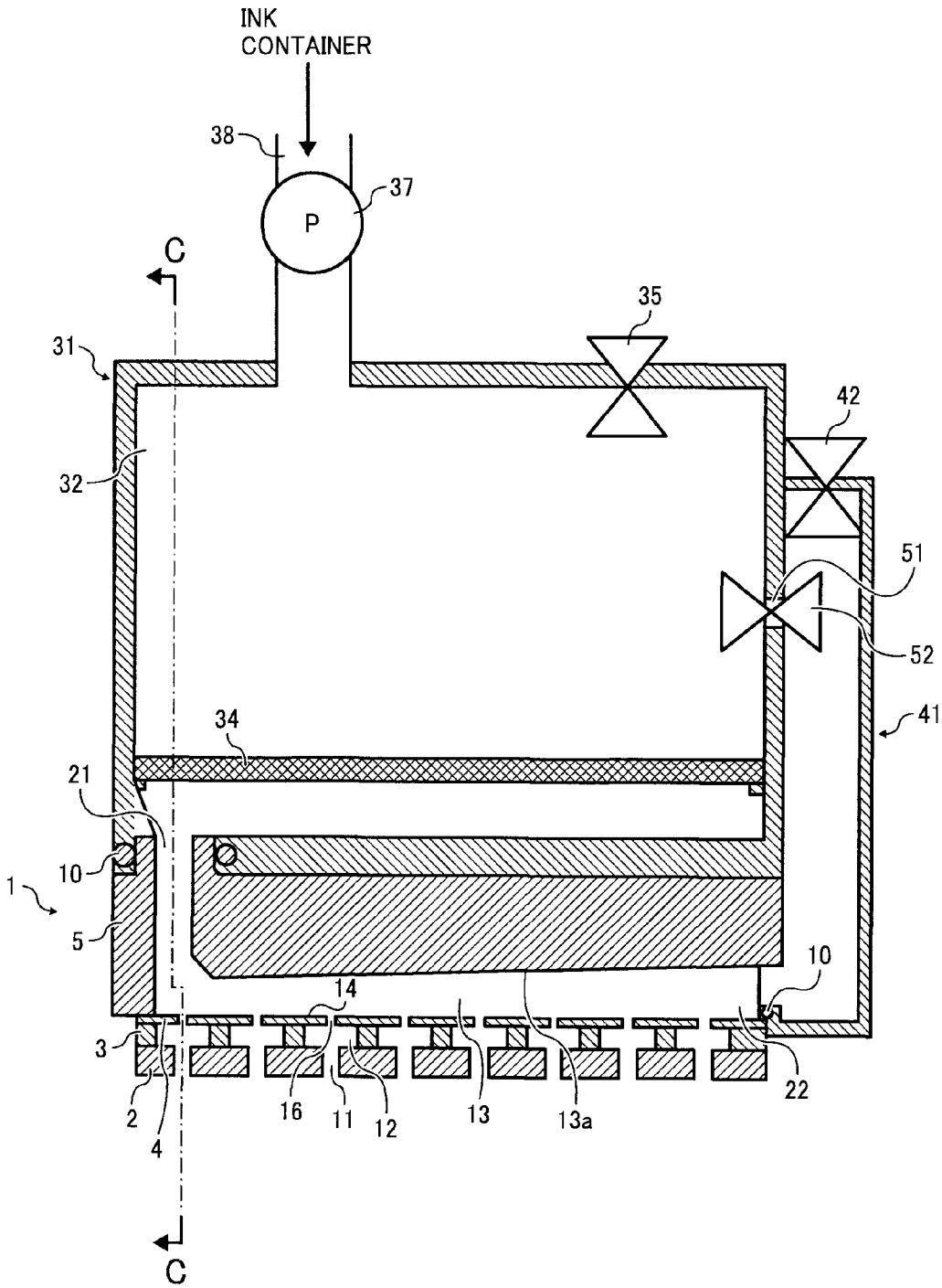
FIG. 5 is a vertical cross-sectional view illustrating a liquid discharge head unit according to a third exemplary embodiment, along a line B-B in FIG. 6.
Figure 6:
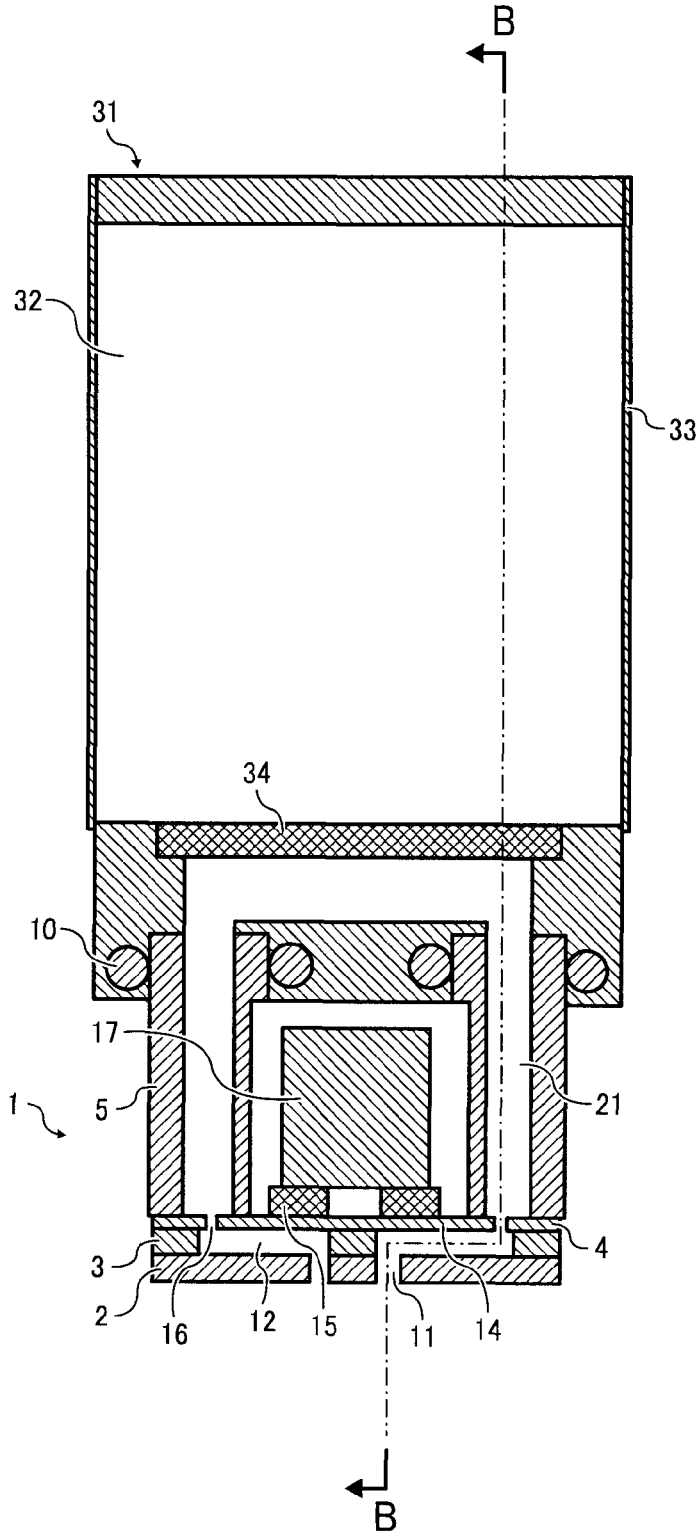
FIG. 6 is a vertical cross-sectional view illustrating the liquid discharge head unit along a line C-C in FIG. 5.

A description is now given of a liquid discharge head unit according to a third exemplary embodiment with reference to FIGS. 5 and 6. FIG. 5 is a vertical cross-sectional view illustrating the liquid discharge head unit according to the third exemplary embodiment along a line B-B in FIG. 6. FIG. 6 is a vertical cross-sectional view illustrating the liquid discharge head unit along a line C-C in FIG. 5.

The liquid discharge head unit according to the third exemplary embodiment includes the liquid discharge head 1 and a tank unit in which a sub tank 31 configured to supply the ink to the liquid discharge head 1 and a tank 41 are integrally included. The liquid discharge head 1 and the tank unit are connected with each other by a seal member 10 such as an O-ring.

The liquid discharge head 1 according to the third exemplary embodiment has the same configuration as that of the liquid discharge head 1 according to the foregoing exemplary embodiments, except that a top surface 13*a* of the common liquid chamber 13 is provided with a slope such that a height of the common liquid chamber 13 is gradually increased from the supply opening 21 to the discharge opening 22. As a result, bubbles in the ink in the common liquid chamber 13 are more reliably discharged from the discharge opening 22.

The sub tank 31 includes an ink tank 32, side surfaces of which are formed by a flexible film 33, and a filter 34, a downstream side of which, relative to a direction of the flow of the ink, faces the supply opening 21. The sub tank 31 further includes a release valve 35 configured to release pressure in the sub tank 31. An ink supply path 38 connected to an ink container such as an ink cartridge and an ink tank, not shown, is connected to the sub tank 31. A pump 37 configured to convey the ink by pressure is provided in the ink supply path 38.

The tank 41, a bottom portion of which is connected to the discharge opening 22, stores the ink used for filling the liquid discharge head 1. The tank 41 includes a release valve 42 configured to release pressure in the tank 41.

A connection path 51 used for returning the ink in the tank 41 to the sub tank 31 is provided between the tank 41 and the sub tank 31, and an open/close valve 52 is provided in the connection path 51.

A description is now given of initial filling operations performed in the liquid discharge head unit with the above-described configuration.

(A) First, the pump 37 is normally rotated while the release valve 35 is opened and the open/close valve 52 and the release valve 42 are closed so that the ink is supplied from the ink container to the sub tank 31. Because the release valve 35 is opened as described above and the filter 34 has greater fluid resistance, the ink preferentially flows in the sub tank 31.

(B) Next, when a predetermined or desired amount of the ink is supplied to the sub tank 31, the release valve 35 is closed and the open valve 42 is opened while the pump 37 is normally rotated continuously. Accordingly, the ink supplied in the sub tank 31 passes through the filter 34 and flows in the common liquid chamber 13 through the supply opening 21. Thereafter, the ink supplied to the common liquid chamber 13 further flows in the tank 41 through the discharge opening 22. Because fluid resistance between the multiple liquid chambers 12 and the common liquid chamber 13 is much greater than that in the common liquid chamber 13 and between the discharge opening 22 and the tank 41, the ink rarely flows in the multiple liquid chambers 12 from the common liquid chamber 13. As a result, air in the tank 41 generally flows towards, and is discharged from, the release valve 42 as the ink flows in the tank 41.

(C) When a predetermined or desired amount of the ink flows in the tank 41, the release valve 42 is closed. The pump 37 is normally rotated continuously so that the multiple liquid chambers 12 and the multiple nozzles 11 are filled with the ink. Although the ink is discharged from the multiple nozzles 11, such ink is either collected or discarded by the cap member of the maintenance and recovery mechanism, not shown.

(D) Thereafter, the release valve 52 is opened so that the tank 41 and the sub tank 31 are connected through the connection path 51. The ink in the tank 41 used for the initial filling operations is returned to a portion upstream from the filter 34 in the sub tank 31 by reversely rotating the pump 37. The ink thus returned to the sub tank 31 is channeled to the ink container.

(E) When a predetermined or desired amount of the ink is channeled to the ink container, the open/close valve 52 is closed and the pump 37 is reversely rotated continuously to generate a negative pressure in the sub tank 31, the common liquid chamber 13, and the multiple liquid chambers 12. As described above, the side walls of the sub tank 31 are formed with the flexible film 33 to reliably generate the negative pressure of from −10 kPa to −50 kPa, which is required for reliably discharging the liquid droplets from the multiple nozzles 11. The reverse rotation of the pump 37 is stopped when a predetermined or desired amount of the negative pressure is obtained. The pump 37 is configured to function as a pipe line when the rotation thereof is stopped.

Alternatively, in the above-described processes, step (D) may be performed before step (C). Moreover, a head difference between the ink container and the liquid discharge head unit may be used in place of the reverse rotation of the pump 37. Specifically, a surface of the ink in the ink container is placed lower than the nozzle plate 2, and the pump 37 is normally rotated to supply the ink from the ink container to the sub tank 31, the supply opening 21, the common liquid chamber 13, the discharge opening 22, the tank 41, and the multiple liquid chambers 12. When the rotation of the pump 37 is stopped, the pump 37 functions as a pipe line so that collection of the ink to the ink container and generation of the negative pressure may be performed by using the head difference between the ink container and the liquid discharge head unit.

During the initial filling operations, the above-described configuration allows the multiple liquid chambers 12 to be filled with the ink after air in the common liquid chamber 13 are entirely moved to the tank 41. Therefore, the bubbles are rarely generated in the ink in the multiple liquid chambers 12. Moreover, the ink in the tank 41 used for the initial filling operations is returned to the sub tank 31 without being discarded. Accordingly, the bubbles are removed from the ink in the sub tank 31 and waste of the ink is minimized. Further, the side walls of the sub tank 31 are formed with the flexible film 33 so that pressure variation due to discharge of the ink droplets and movement of a carriage including the liquid discharge head 1 is absorbed, thereby more reliably discharging the ink droplets.

Thus, according to the third exemplary embodiment, the liquid discharge head 1 includes the multiple liquid chambers 12 connected to the multiple nozzles 11 for discharging the liquid droplets, and the common liquid chamber 13 configured to supply the ink to the multiple liquid chambers 12. The common liquid chamber 13 includes the supply opening 21 and the discharge opening 22. The supply opening 21 is connected to the sub tank 31 configured to store the ink to be supplied to the liquid discharge head 1, and the discharge opening 22 is connected to the tank 41 configured to store the ink used for the initial filling operations. The ink in the tank 41 used for the initial filling operations is returned to the sub tank 31 by reversely rotating the pump 37, and bubbles are removed from the ink in the sub tank 31. Thereafter, the ink is channeled to the ink container for reuse.

More specifically, because the ink is returned to the sub tank 31 through the tank 41 instead of being directly returned to the sub tank 31 from the discharge opening 22, the ink is returned to the sub tank 31 after bubbles therein are reliably removed in the tank 41. On the other hand, if the ink used for the initial filling operations is directly returned to the sub tank 31, bubbles therein are insufficiently removed. Consequently, the ink with the bubbles is reused for printing, degrading image quality. In contrast, by providing the tank 41, the ink is returned to the sub tank 31 after the bubbles therein are mostly removed in the tank 41. Because the bubbles are further removed from the ink in the sub tank 31, the ink with few bubbles is more reliably and efficiently returned to the ink container for reuse.

Figure 7:
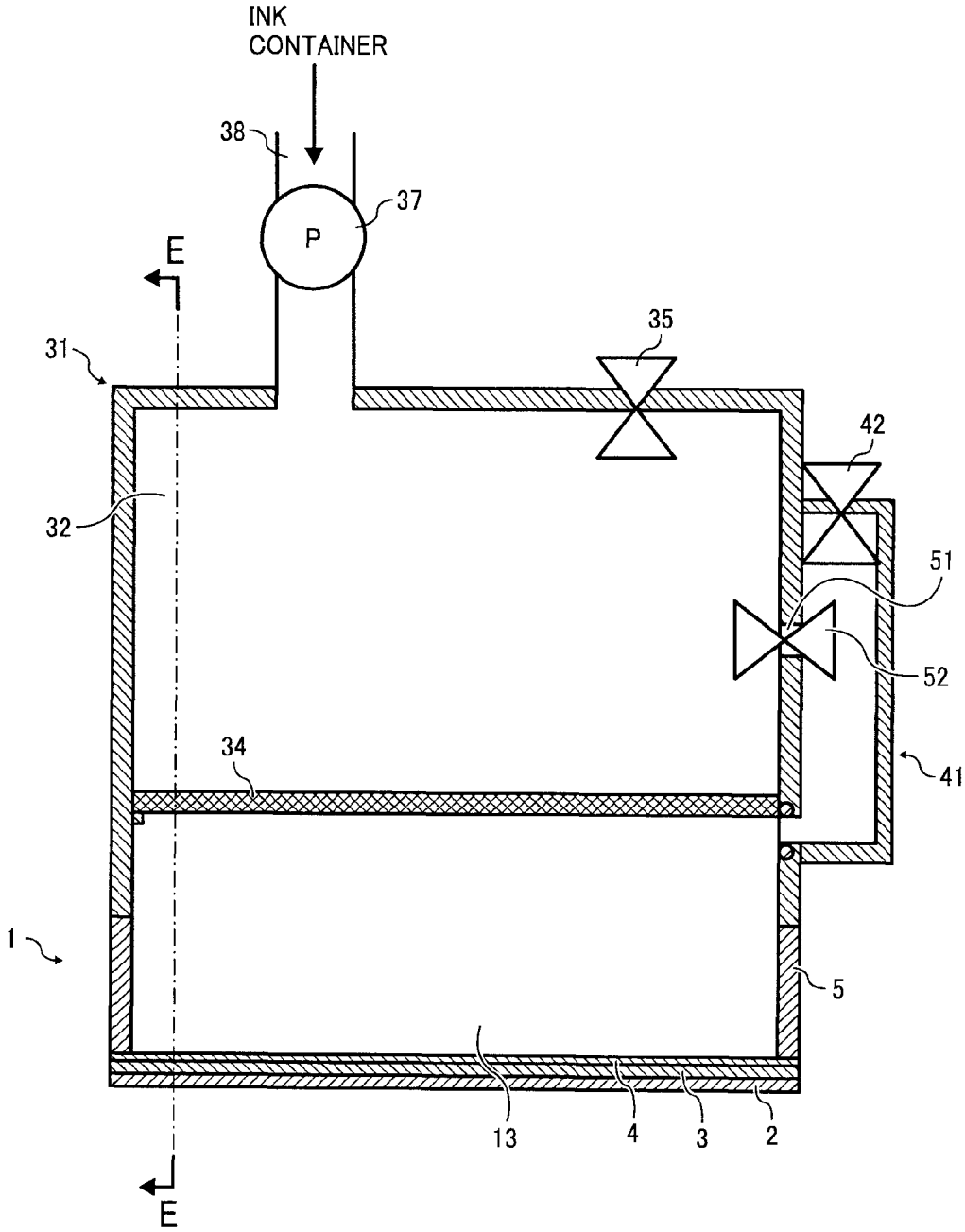
FIG. 7 is a vertical cross-sectional view illustrating a liquid discharge head unit according to a fourth exemplary embodiment, along a line D-D in FIG. 8.
Figure 8:
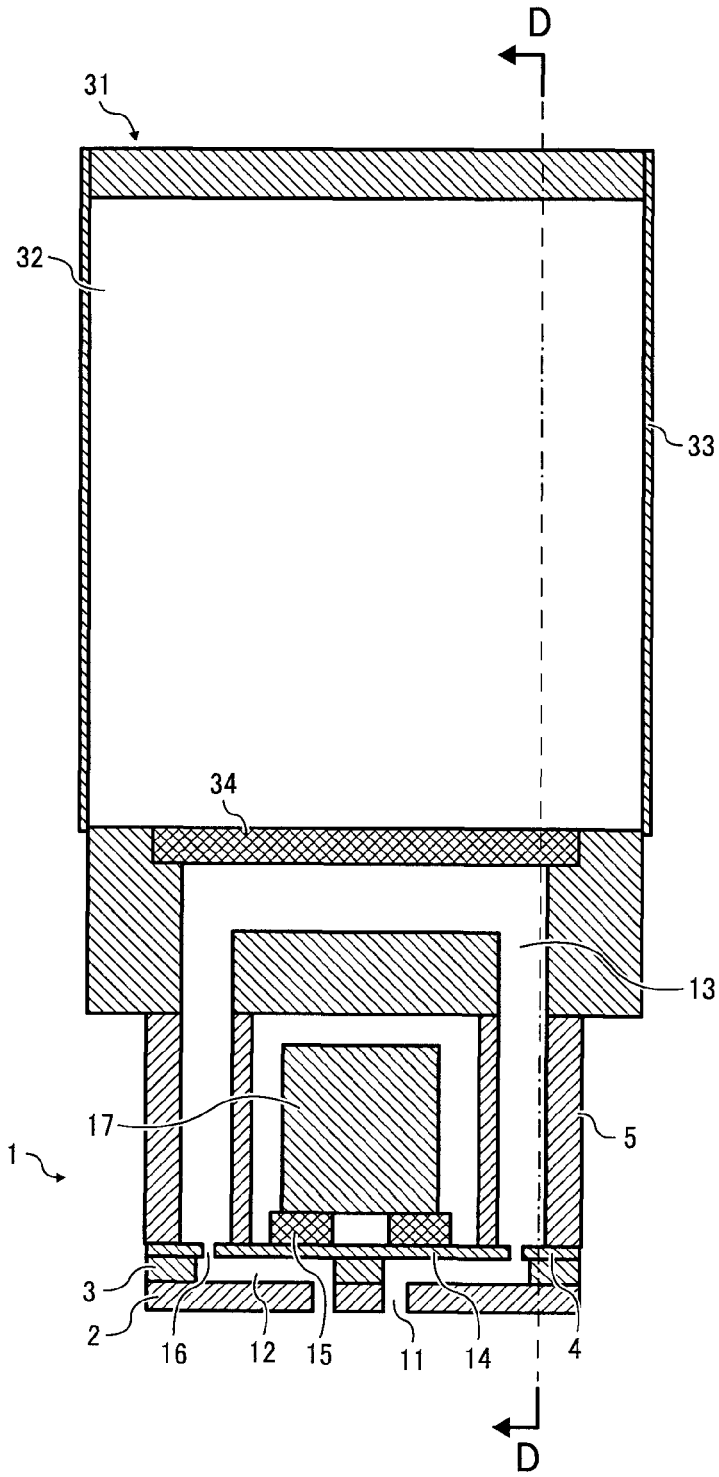
FIG. 8 is a vertical cross-sectional view illustrating the liquid discharge head unit along a line E-E in FIG. 7.

A description is now given of a liquid discharge head unit according to a fourth exemplary embodiment with reference to FIGS. 7 and 8. FIG. 7 is a vertical cross-sectional view illustrating the liquid discharge head unit according to the fourth exemplary embodiment along a line D-D in FIG. 8. FIG. 8 is a vertical cross-sectional view illustrating the liquid discharge head unit along a line E-E in FIG. 7.

According to the fourth exemplary embodiment, the filter 34 is provided between the ink tank 32 and the common liquid chamber 13 such that the common liquid chamber 13 is entirely connected to the sub tank 31.

Because the configuration of the common liquid chamber 13 according to the third exemplary embodiment may cause pressure loss due to the flow of the ink from the supply opening 21 to the tank 41, a speed of the flow of the ink may decrease. Although the pressure loss rarely causes the problem in a liquid discharge head unit having a smaller number of nozzles, the pressure loss causes reduction of the speed of flow of the ink in a long liquid discharge head unit such as a line type liquid discharge head unit because the long liquid discharge head unit includes a longer common liquid chamber and a larger number of nozzles. Consequently, bubbles and foreign substances tend to remain in a portion with a slower speed of flow of the ink.

On the other hand, the common liquid chamber 13 of the liquid discharge head unit according to the fourth exemplary embodiment has a shape without narrow portions so as to minimize the pressure loss. Such a configuration equalizes distribution of pressure and speed of flow of the ink in the common liquid chamber 13, thereby preventing the bubbles and the foreign substances from remaining in the common liquid chamber 13. The above-described configuration is effective especially in the long liquid discharge head unit and a full-line type liquid discharge head unit having a larger number of nozzles. In the long liquid discharge head unit, because a larger number of ink droplets is discharged, an area of the filter 34 is increased to reduce fluid resistance and prevent short supply of the ink to the common liquid chamber 13 from the sub tank 31.

Thus, according to the fourth exemplary embodiment, the liquid discharge head 1 includes the multiple liquid chambers 12 connected to the multiple nozzles 11 for discharging the liquid droplets, and the common liquid chamber 13 configured to supply the ink to the multiple liquid chambers 12. The liquid discharge head 1 further includes the filter 34 provided between the ink container 32 and the common liquid chamber 13. The sub tank 31 stores the ink to be supplied to the liquid discharge head 1. The tank 41 connected to the common liquid chamber 13 stores the ink used for the initial filling operations performed in the liquid discharge head 1. The ink in the tank 41 is returned to the sub tank 31 by reversely rotating the pump 37, and bubbles are removed from the ink in the sub tank 31. Thereafter, the ink is channeled to the ink container for reuse. Moreover, the above-described configuration prevents short supply of the ink to the common liquid chamber 13 from the sub tank 31 when the long liquid discharge head unit is used.

Figure 9:
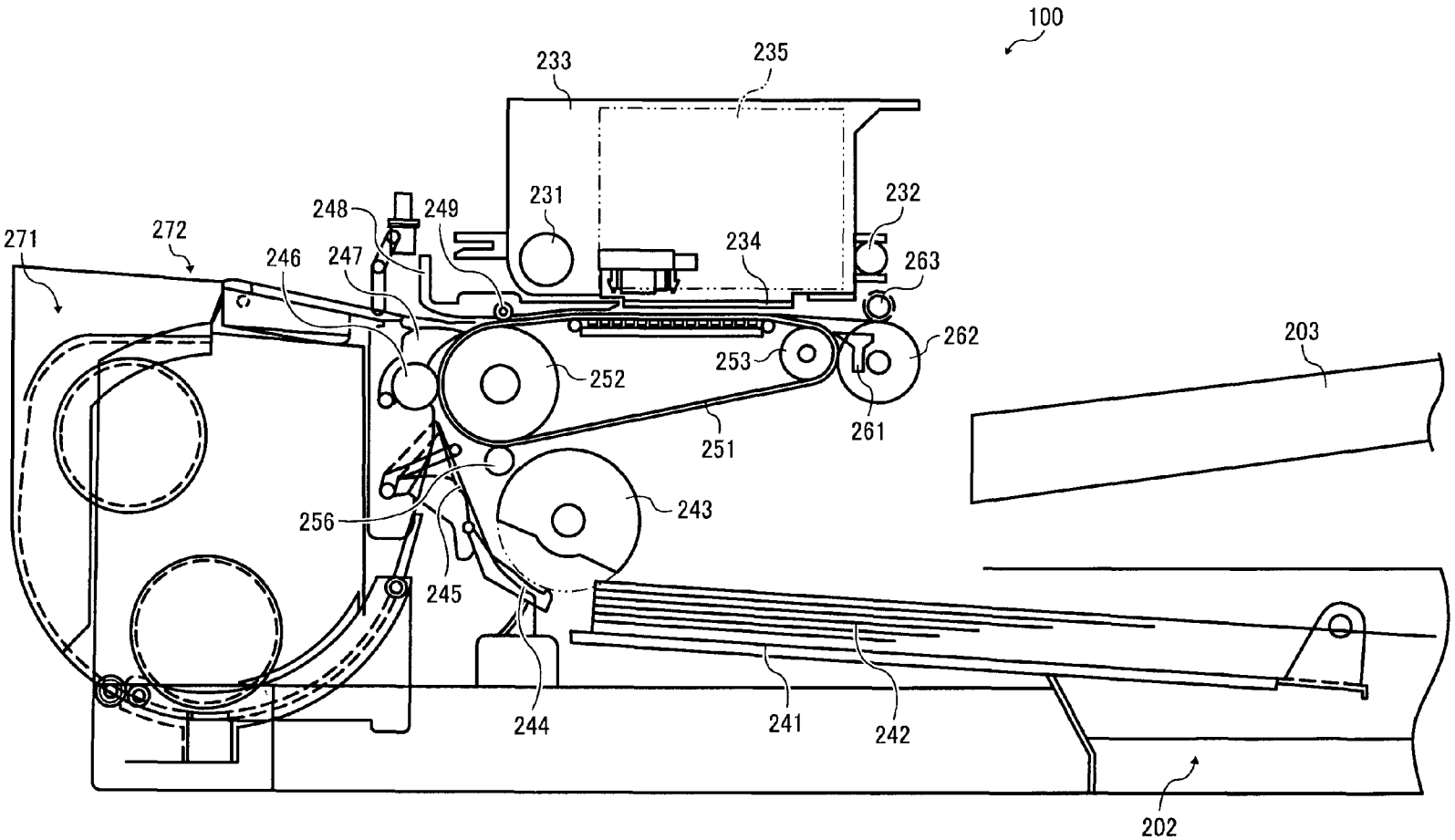
FIG. 9 is a schematic view illustrating a configuration of an image forming apparatus including the liquid discharge head unit according to the exemplary embodiments viewed from a lateral side.
Figure 10:
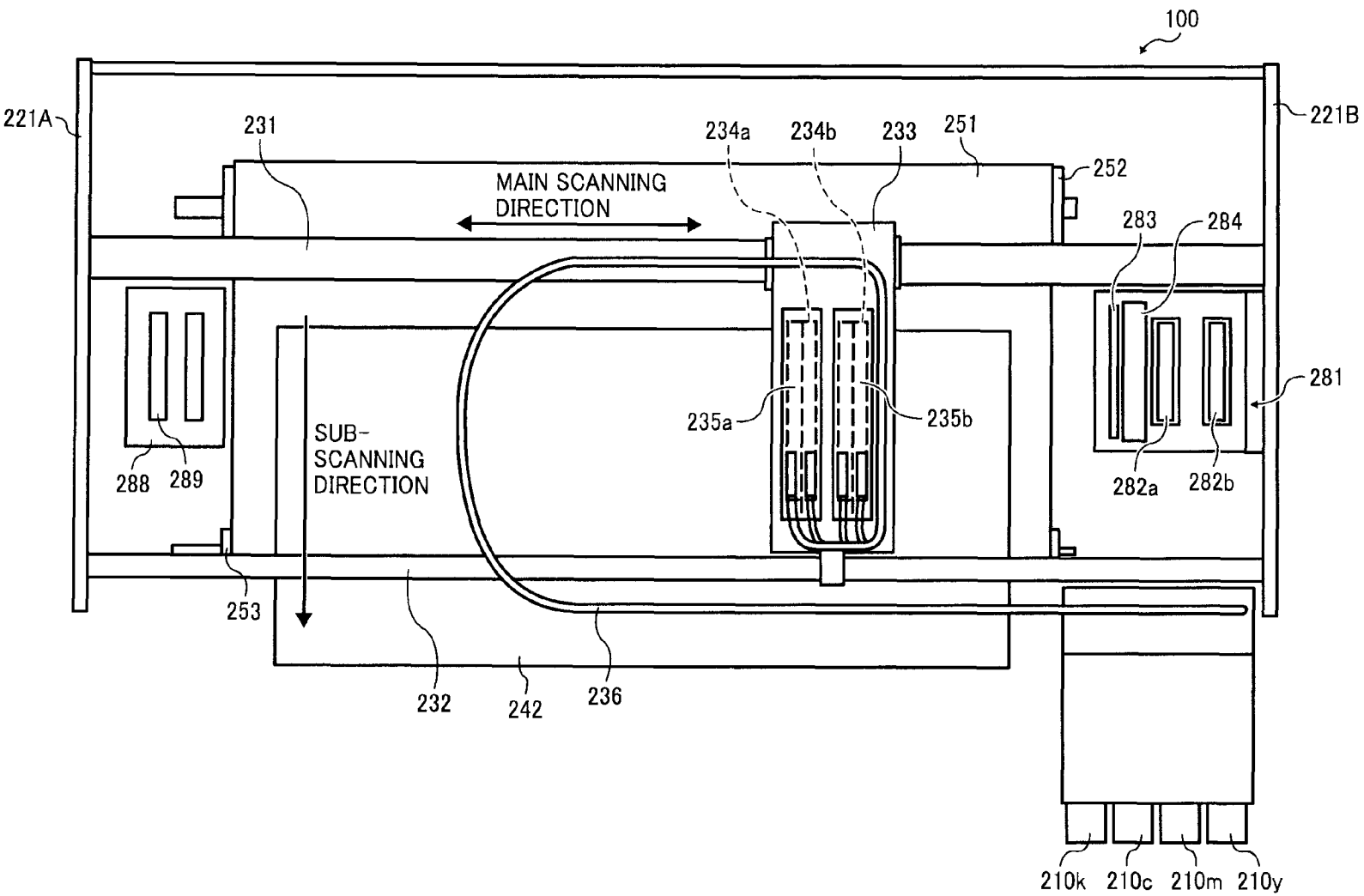
FIG. 10 is a plan view illustrating main components of the image forming apparatus illustrated in FIG. 9.

A description is now given of an example of an image forming apparatus including the liquid discharge head unit according to the foregoing exemplary embodiments with reference to FIGS. 9 and 10. FIG. 9 is a schematic view illustrating a configuration of the image forming apparatus viewed from a lateral side. FIG. 10 is a plan view illustrating main components of the image forming apparatus illustrated in FIG. 9.

Referring to FIGS. 9 and 10, a serial type image forming apparatus 100 includes main guide rods 231 and 232 extending across left and right side walls 221A and 221B. The main guide rods 231 and 232 slidably support a carriage 233 in a main scanning direction. The carriage 233 is moved in the main scanning direction by a main scanning motor, not shown, via a timing belt.

The carriage 233 includes recording heads 234*a* and 234*b* (hereinafter collectively referred to as recording heads 234) including the liquid discharge head 1 according to the foregoing exemplary embodiments configured to discharge ink droplets of each color of yellow (Y), cyan (C), magenta (M), and black (K). The recording heads 234 include arrays of nozzles in a sub-scanning direction perpendicular to the main scanning direction. The recording heads 234 are provided such that the ink droplets are discharged downward.

Each of the recording heads 234 includes two arrays of nozzles. One of the two arrays of nozzles provided in the recording head 234*a* discharges the ink droplets of black (K), and the other array of nozzles discharges the ink droplets of cyan (C). One of two arrays of nozzles provided in the recording head 234*b* discharges the ink droplets of magenta (M), and the other array of nozzles discharges the ink droplets of yellow (Y).

The carriage 233 further includes sub tanks 235*a* and 235*b* (hereinafter collectively referred to as sub tank 235) configured to supply the ink of each color to the respective arrays of nozzles in the recording heads 234. The ink of each color is supplied to the sub tank 235 from respective ink cartridges 210*k*, 210*c*, 210*m*, and 210*y* through a supply tube 236. The liquid discharge head unit according to the third exemplary embodiment described above includes the recording head 234, the sub tank 235, and a tank, not shown.

The serial type image forming apparatus 100 further includes a paper feed tray 202, a paper carrying plate 241, paper feed roller 243 configured to feed sheets 242 on the paper carrying plate 241 sheet by sheet, and a separation pad 244 facing the paper feed roller 243. The separation pad 244 includes a material having a larger friction coefficient, and is pressed against the paper feed roller 243.

The serial type image forming apparatus 100 further includes a guide member 245, a counter roller 246, a conveyance guide member 247, a pressing member 248 including a leading edge pressing roller 249 such that the sheet 242 fed from the paper feed tray 202 is conveyed below the recording head 234. A conveyance belt 251 electrostatically attracts the sheet 242 so as to convey the sheet 242 to a portion opposite to the recording head 234.

The conveyance belt 251 is a seamless belt, and is extended between a conveyance roller 252 and a tension roller 253 so as to rotate in the sub-scanning direction. A surface of the conveyance belt 251 is charged by a charging roller 256. The charging roller 256 contacts the surface of the conveyance belt 251 so as to rotate along with the rotation of the conveyance belt 251. The conveyance belt 251 is rotated in the sub-scanning direction along with the rotation of the conveyance roller 252 by a sub scanning motor, not shown, via a timing belt.

The serial type image forming apparatus 100 further includes a discharge unit to which the sheet 242 having an image recorded by the recording head 234 thereon is discharged. The discharge unit includes a separation pick 261 for separating the sheet 242 from the conveyance belt 251, discharge rollers 262 and 263, and a discharge tray 203 provided below the discharge roller 262.

A duplex unit 271 is detachably attached to a back side of the serial type image forming apparatus 100. The sheet 242 is conveyed to the duplex unit 271 by reversely rotating the conveyance belt 251. The sheet 242 is reversed in the duplex unit 271 and conveyed between the counter roller 246 and the conveyance belt 251 again. The duplex unit 271 includes a manual paper feed tray 272 on a top surface thereof.

A maintenance and recovery mechanism 281 configured to control conditions of the nozzles in the recording head 234 is provided at an edge of a non-printing area in the main scanning direction. The maintenance and recovery mechanism 281 includes cap members 282*a* and 282*b* (hereinafter collectively referred to as cap members 282) configured to cap a surface of the recording head 234 having the nozzles thereon, a wiper blade 283 configured to wipe such surface of the recording head 234, and a liquid droplet receiver 284 configured to receive liquid droplets not used for recording discharged from the nozzles in order to remove the ink adhering to the nozzles.

An ink collecting unit 288 configured to collect the liquid droplets not used for recording discharged from the nozzles in order to remove the ink adhering to the nozzles during recording is provided at the other edge of the non-printing area in the main scanning direction. The ink collecting unit 288 includes an opening 289 along a direction of the array of the nozzles in the recording head 234.

In the serial type image forming apparatus 100 with the above-described configuration, the sheet 242 is fed from the paper feed tray 202 sheet by sheet in a substantially upward vertical direction. The sheet 242 thus fed is guided by the guide member 245 and conveyed between the conveyance belt 251 and the counter roller 246. Thereafter, a leading edge of the sheet 242 is guided by the conveyance guide member 247, and pressed against the conveyance belt 251 by the leading edge pressing roller 249 to change a conveyance direction of the sheet 242 at substantially 90 degrees.

Simultaneously, positive and negative voltages are alternately applied to the charging roller 256 so that the conveyance belt 251 is alternately charged with positive and negative polarities with a predetermined or desired interval in the sub-scanning direction. When being conveyed onto the conveyance belt 251 alternately charged with the positive and negative polarities, the sheet 242 is attracted to the conveyance belt 251 and conveyed in the sub-scanning direction along with the rotation of the conveyance belt 251.

The recording head 234 is driven in response to an image signal while the carriage 233 is moved so that a line of an image is recorded on the sheet 242 which is not in motion by discharging the ink droplets to the sheet 242. After the sheet 242 is conveyed by a predetermined distance, a next line of the image is recorded on the sheet 242 in a similar manner as described above. When receiving a recording completion signal or a signal indicating that a rear edge of the sheet 242 reaches the non-printing area, the recording head 234 finishes the recording operations, and the sheet 242 having the recorded image thereon is discharged to the discharge tray 203.

As described above, the serial type image forming apparatus 100 includes the liquid discharge head unit according to the foregoing exemplary embodiments so that the ink used for the initial filling operations can be collected for reuse, thereby minimizing waste of ink.

In the above-described example, the liquid discharge head unit according to the foregoing exemplary embodiments is employed in the serial type image forming apparatus 100. Alternatively, the liquid discharge head unit according to the foregoing exemplary embodiments may be employed in any liquid discharge devices. More specifically, the liquid discharge head unit according to the foregoing exemplary embodiments may be employed in liquid discharge devices and image forming apparatuses in which a DNA sample, a resist material, a pattern material, and a liquid other than a recording liquid is used for recording.

As can be appreciated by those skilled in the art, numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese Patent Application No. 2007-174936 filed on Jul. 3, 2007 in the Japan Patent Office, the entire contents of which are hereby incorporated herein by reference.

What is claimed is:

1. An image forming apparatus comprising a liquid discharge head unit, the liquid discharge head unit comprising:

a liquid discharge head comprising multiple liquid chambers connected to multiple nozzles for discharging liquid droplets, and a common liquid chamber including a liquid supply opening and a liquid discharge opening, the common liquid chamber being configured to supply a liquid to the multiple liquid chambers;

a sub tank comprising a liquid container configured to store the liquid conveyed from an ink container by operation of a pump normally to supply the liquid through the liquid supply opening to the liquid discharge head;

a tank connected to the liquid discharge opening and configured to store the liquid flowing through the liquid discharge opening from the liquid discharge head; and a mechanism configured to return the liquid in the tank to the sub tank by operation of the pump reversely.

2. The image forming apparatus according to claim 1, wherein the liquid discharge head unit further comprises a filter between the liquid container of the sub tank and the liquid supply opening, wherein the mechanism returns the liquid in the tank to a portion upstream from the filter in the sub tank.

3. The image forming apparatus according to claim 1, wherein the tank further comprises a valve configured to be opened to release pressure in the tank.

4. The image forming apparatus according to claim 1, wherein the sub tank includes a release valve configured to be opened when the liquid is being supplied into the sub tank.

5. The image forming apparatus according to claim 1, wherein the liquid discharge head unit further comprises a pump connected to the sub tank and configured to operate normally to supply the liquid from an external container to the sub tank by pressure and to operate reversely to cause the liquid in the tank to be returned to the sub tank.

6. The image forming apparatus of claim 1, wherein the liquid discharge head unit further comprises:

a connection path configured to connect the liquid supply opening and the liquid discharge opening;

an open/close valve configured to open and close the connection path, the tank being provided between the liquid discharge opening and the open/close valve;

a first release valve configured to release pressure in the sub tank; and a second release valve configured to release pressure in the tank; and a pump configured to operate normally while the first release valve is open, the second release valve is closed and the open/close valve is closed, to convey the liquid from the ink container to the subtank, and to operate normally while the first release value is closed and the second release valve is open, to convey the liquid in the sub tank to the liquid discharge head, wherein the pump operates reversely while the open/close valve remains open, to return the liquid in the tank to the sub tank.

7. The image forming apparatus according to claim 6, wherein fluid resistance in the common liquid chamber is different from fluid resistance in the connection path.

8. The image forming apparatus according to claim 6, wherein air is discharged through said second release valve when the liquid is flowing into the liquid discharge head.

9. The image forming apparatus according to claim 6, wherein the tank collects and stores the liquid flowing through the liquid discharge opening from the liquid discharge head, and the liquid collected and stored in the tank is recirculated through the connection path, when the open/close valve is open, to the liquid supply opening.

10. The image forming apparatus according to claim 1, wherein the tank collects and stores the liquid flowing through the liquid discharge opening from the liquid discharge head, and the mechanism returns the liquid collected and stored in the tank to the sub tank.

11. An image forming apparatus comprising a liquid discharge head unit, the liquid discharge head unit comprising:

a liquid discharge head comprising multiple liquid chambers connected to multiple nozzles for discharging liquid droplets, and a common liquid chamber to supply a liquid to the multiple liquid chambers;

a sub tank comprising a liquid container configured to store the liquid conveyed from an ink container by operation of a pump normally to supply the liquid through the liquid supply opening to the liquid discharge head;

a filter provided between the common liquid chamber and the liquid container of the sub tank;

a tank connected to the common liquid chamber and configured to store the liquid flowing from the common liquid chamber of the liquid discharge head to the tank; and a mechanism configured to return the liquid in the tank to the sub tank by operation of the pump reversely.

12. The image forming apparatus according to claim 11, wherein the tank further comprises a valve to release pressure in the tank.

13. The image forming apparatus according to claim 11, wherein the liquid discharge head unit further comprises a pump connected to the sub tank and configured to operate normally to supply the liquid from an external container to the sub tank by pressure and to operate reversely to cause the liquid in the tank to be returned to the sub tank.

14. An image forming apparatus comprising:

a liquid container; and a liquid discharge head unit configured to receive liquid from the liquid container, the liquid discharge head unit comprising:

a liquid discharge head comprising multiple liquid chambers connected to multiple nozzles for discharging liquid droplets, and a common liquid chamber comprising a liquid supply opening and a liquid discharge opening, the common liquid chamber being configured to supply liquid to the multiple liquid chambers;

a connection path configured to connect the liquid supply opening and the liquid discharge opening;

an open/close valve configured to open and close the connection path;

a tank provided between the liquid discharge opening and the open/close valve, to collect and store liquid flowing through the liquid discharge opening from the liquid discharge head;

a release valve configured to release pressure in the tank; and a pump that operates normally while the open/close valve is closed and the release valve is opened, to cause the liquid from the liquid container to be supplied to the liquid discharge head, and operates reversely while the open/close valve is opened, to cause the liquid collected in the tank to return to the liquid container.

* * * * *